US006536734B1

(12) United States Patent
Brijmohan et al.

(10) Patent No.: US 6,536,734 B1
(45) Date of Patent: Mar. 25, 2003

(54) PORTABLE DAVIT MOUNTING ASSEMBLY

(75) Inventors: Lakhram Brijmohan, Mississauga (CA); Roman Gargulak, Nepean (CA)

(73) Assignee: Tractel Ltd., Scarborough (CA)

( * ) Notice: Subject to any disclaimer, the term of this patent is extended or adjusted under 35 U.S.C. 154(b) by 0 days.

(21) Appl. No.: 10/118,938

(22) Filed: Apr. 10, 2002

(51) Int. Cl.[7] ..... F16M 13/00
(52) U.S. Cl. ..... 248/544; 248/500
(58) Field of Search ..... 248/544, 500, 248/220.21, 221.12, 222.41, 507; 52/116, 117, 118, 698, 707; 182/142, 150

(56) References Cited

U.S. PATENT DOCUMENTS 4,545,558 A 10/1985 Crudele ..... 248/544
4,590,719 A * 5/1986 McKibbin ..... 52/116
4,714,226 A * 12/1987 Tracy ..... 248/544
4,907,782 A * 3/1990 Hoekstra ..... 254/134.3 PA
5,438,805 A * 8/1995 McCrary ..... 52/116
5,467,569 A * 11/1995 Chiodo ..... 52/713
5,782,446 A 7/1998 Ghahremani ..... 248/220.21
6,322,038 B1 * 11/2001 Ghahremani ..... 248/544

* cited by examiner

*Primary Examiner*—Anita King
*Assistant Examiner*—Gwendolyn Baxter
(74) *Attorney, Agent, or Firm*—Arne I. Fors

(57) ABSTRACT

A portable davit mounting assembly and method for removable attachment to a rooftop pedestal and mounting plate. The portable davit base adaptor assembly is inserted into a mounting plate of a fixed davit pedestal and is secured with pins. The portable davit base adaptor assembly includes two opposed side plates and two metal transverse supporting members. The opposed side plates have apertures for inserting davit supporting pins and interlocking feet for inserting into mounting plate apertures. The transverse supporting members have holes for inserting pins to secure them to the pedestal mounting plate. The rooftop pedestal and mounting plate can be installed flush to the rooftop. A davit arm is rigidly attached to the portable davit base adaptor assembly for use in suspending scaffolding over the side of a building.

12 Claims, 4 Drawing Sheets

22
15
36
16
23
22
14
23
2
18
20
17
30
18
7a
7
10
11
9
6
8
9
4
5

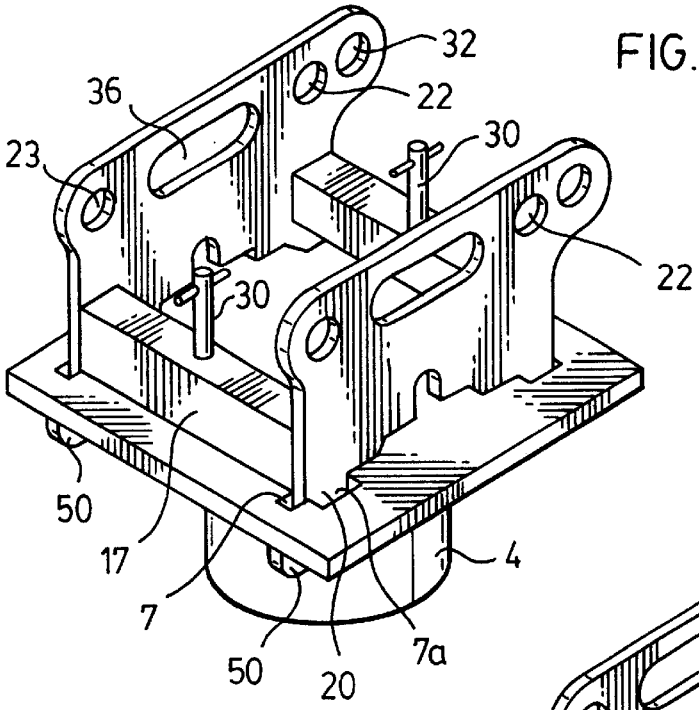
FIG. 2.
FIG. 3.
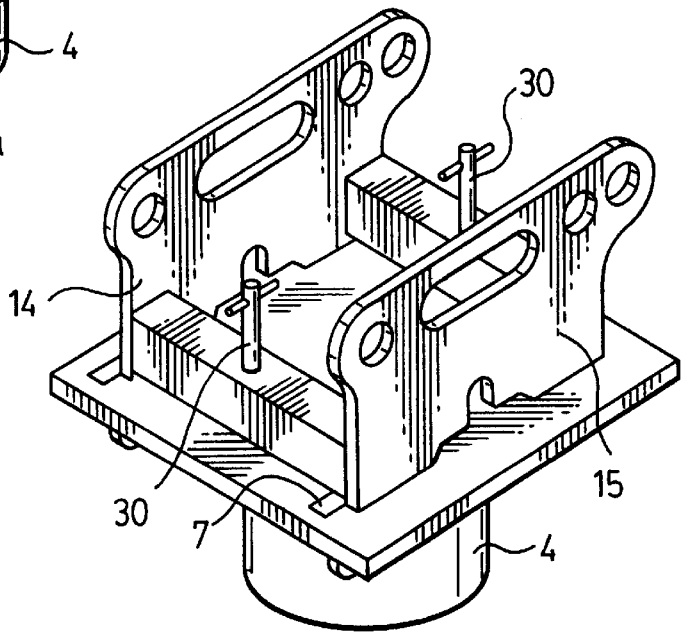
FIG. 4.
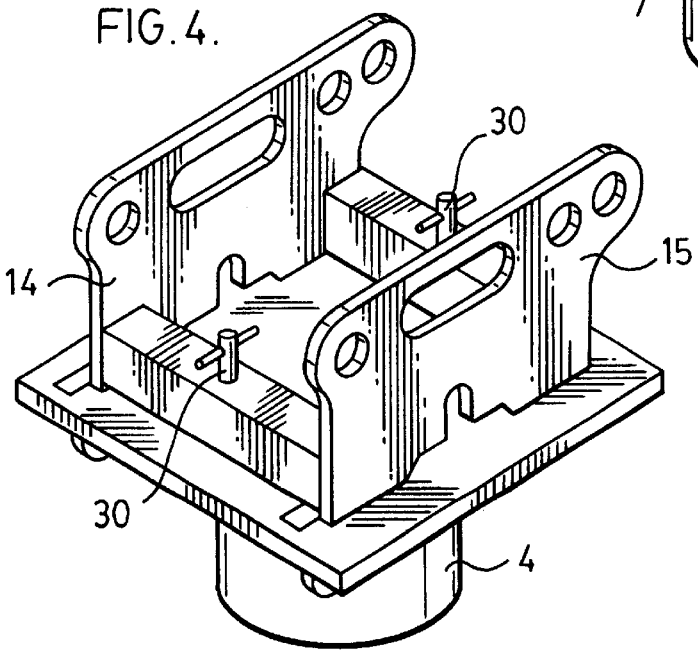

PORTABLE DAVIT MOUNTING ASSEMBLY

BACKGROUND OF THE INVENTION (i) Field of the Invention

This invention relates to a method and apparatus for mounting davit assemblies on rooftops. More particularly, the invention relates to an improved davit system that is portable and can be installed flush to or projecting upwardly from the rooftop.

(ii) Description of the Related Art

Roof top davit systems have long been used by workmen for window washing, painting, maintenance, and the like. It is common practice to provide pairs of davits from which scaffolding can be lowered and raised on the outside of buildings using suspension lines.

U.S. Pat. No. 4,545,558 was granted Oct. 8, 1985 to Richard E. Crudele for a platform suspending davit mounting apparatus and method. The invention includes a mounting socket assembly with wheels and a handle for movement, and a locking clamp to engage a mounting pedestal platform. The socket is adapted to receive a davit.

U.S. Pat. No. 5,782,446 granted to Ali Ghahremani Jul. 21, 1998 describes a davit mounting assembly mounted on a generally circular mounting plate for positioning of the davit mounting assembly at any rotational angle.

SUMMARY OF THE INVENTION

The present invention provides an improved portable davit mounting assembly and method for removable attachment to a rooftop pedestal and mounting plate. The davit mounting assembly has a simple design with few parts. The rooftop pedestal and mounting plate can be installed flush to the rooftop when aesthetics or pedestrian traffic are of concern. The portable davit base adaptor is lightweight and comes with handgrips, so that one person can carry it.

In its broad aspect, the davit mounting assembly of the assembly includes a mounting plate for attachment to a davit pedestal, and a portable davit base adaptor assembly having a pair of spaced-apart opposed side plates joined together by a pair of transverse support members fixedly attached to said side plates. The mounting plate includes two pairs of spaced-apart foot apertures and a mounting plate securing pin aperture located between each pair of spaced-apart foot apertures. The opposed side plates each have front and back davit pin apertures formed in axial alignment with corresponding apertures of the opposed side plate such as to form two pairs of base adaptor pivot pin apertures, each pair able to receive a davit pivot pin, and each pair of base adaptor pivot pin apertures being in further alignment with the corresponding transverse support member. Each side plate has downwardly extending legs, front and back, with feet adapted to be received by and interlocked with the mounting plate foot apertures. Each said transverse support member has a vertical aperture for receiving a securing pin for vertical alignment and securement with a mounting plate securing pin aperture when both pairs of feet are interlocked with pairs of mating mounting plate foot apertures, such that insertion of a davit pivot pin in a pair of aligned side plate base adaptor pivot pin apertures blocks removal of the securing pin whereby the pairs of feet interlocked with mating apertures are prevented from removal.

More specifically, the davit mounting assembly is assembled by inserting the legs and interlocking feet of the portable davit base adaptor assembly into the foot apertures of the mounting plate of the fixed davit pedestal and moving the portable davit base adaptor laterally to engage the fitted legs and feet with the mounting plate. Securing pins are then inserted through the transverse member securing pin holes and into the mounting plate securing pin apertures, thusly attaching the portable davit base adaptor to the mounting plate.

Each side plate leg has an enlarged distal foot and each aperture is a key hole comprising an enlarged slot adapted to receive an enlarged distal foot therethrough and a narrow slot adjacent the enlarged slot for lateral reception of a leg therein, whereby the enlarged distal feet can engage and become hooked to the mounting plate.

A transverse member securing pin hole and mounting plate securing aperture, with the securing pin inserted, are equidistant between one pair of the concentric base adaptor pivot pin apertures, such that the centre axis line of the inserted securing pin will extendedly intersect with the axis of the concentric base adaptor pivot pin apertures, thusly, when a linear davit pivot pin is inserted in the base adaptor pivot pin apertures it will be directly above the installed securing pin, locking the securing pin in place. This also ensures that the looking pin is in place and engages the base mounting plate before the davit pins can be inserted.

A davit mast, which has at its base pivot pin apertures designed to fit inside of the base adaptor pivot pin apertures, can be installed using davit pivot pins.

BRIEF DESCRIPTION OF THE DRAWINGS

A preferred embodiment of the invention will now be described with reference to the drawing in which:

Figure 1:
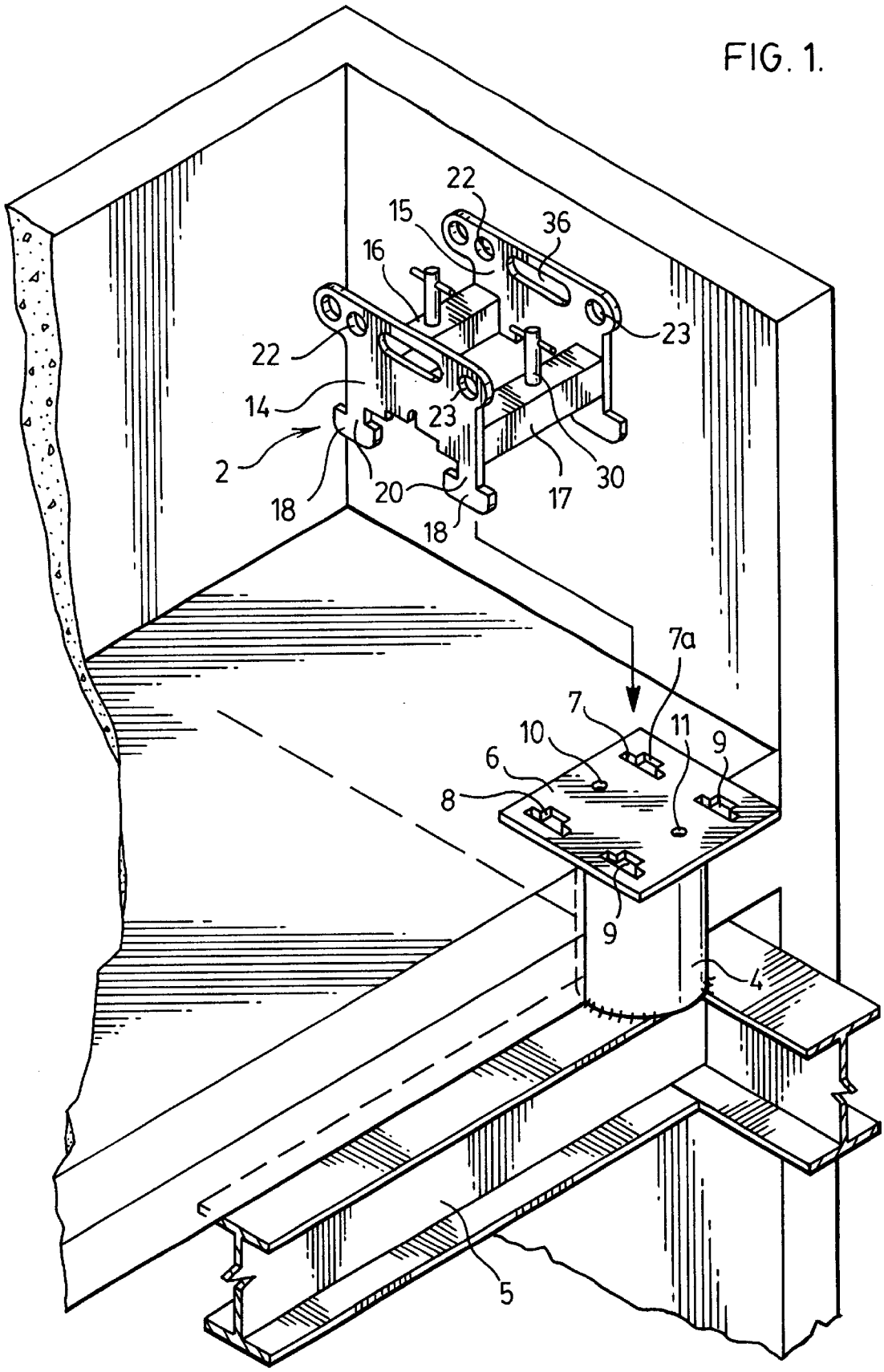
Figure 5:
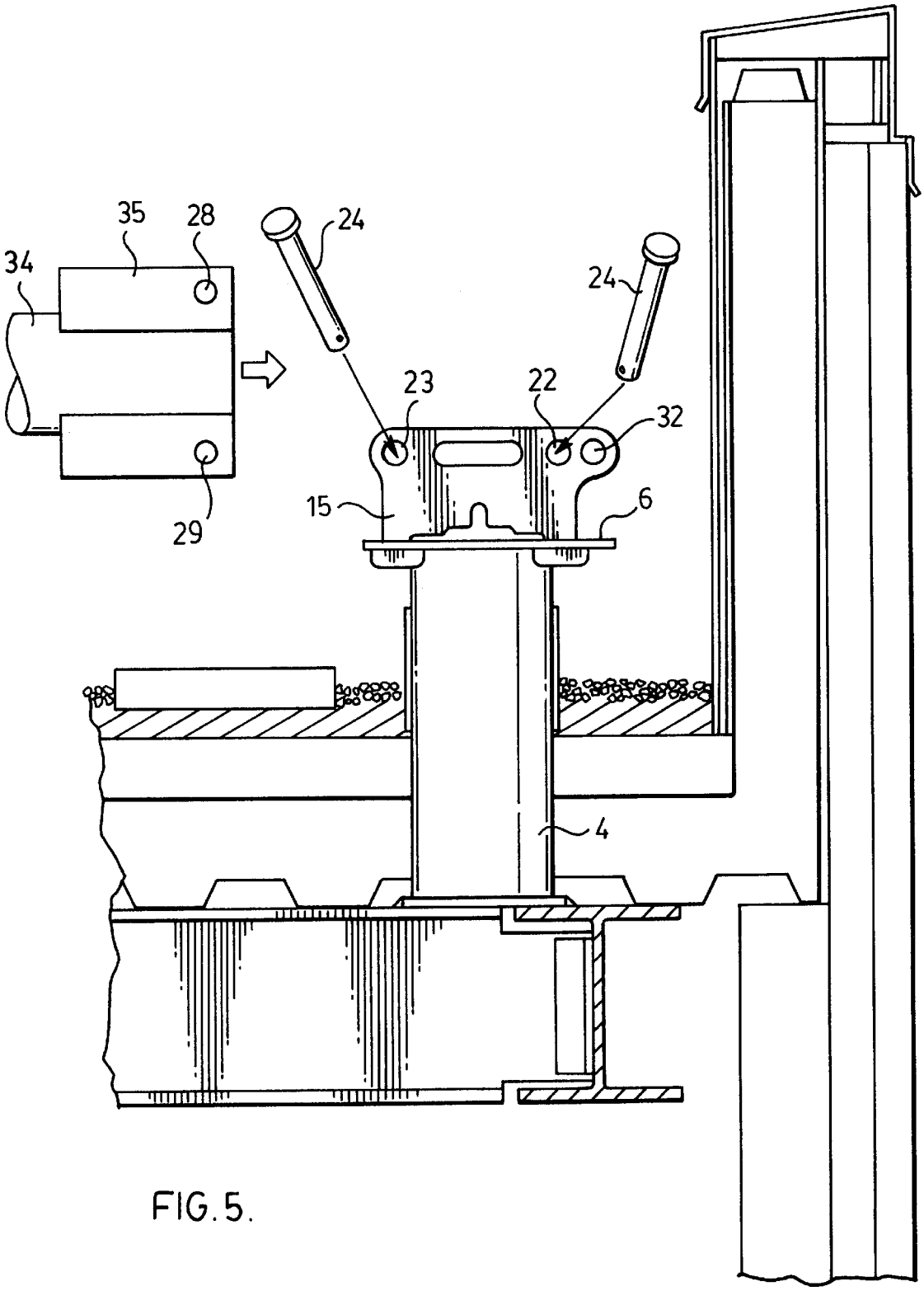
Figure 6:
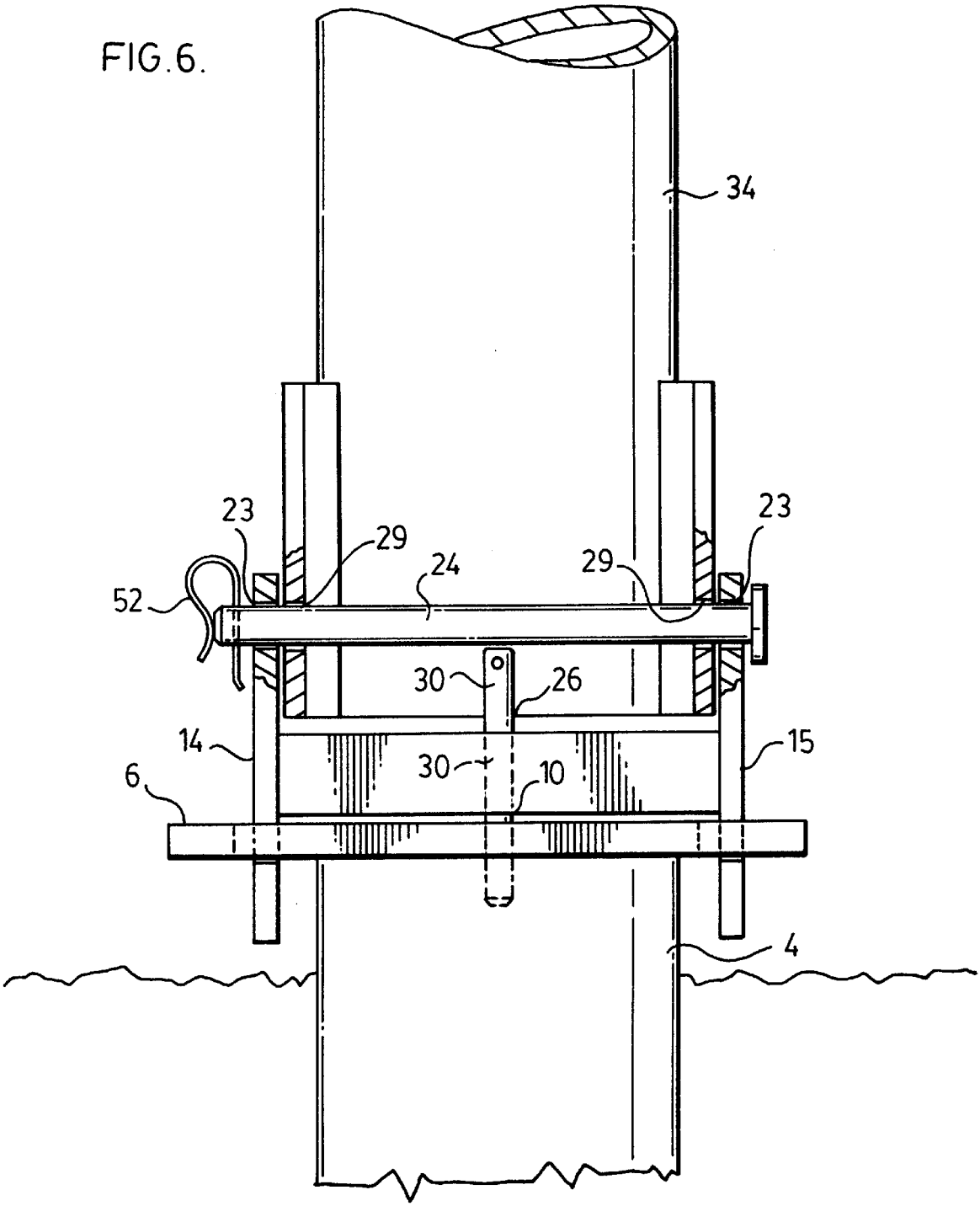

| | |
|---|---|
| FIG. 1 | is a perspective view of the portable davit base separated from adaptor above the mounting plate and davit pedestal, of the invention, which are attached to a roof shown partially cut away for clarity of illustration; |
| FIG. 2 | is a perspective view of the portable davit base adaptor sitting in the larger slot apertures of the mounting plate; |
| FIG. 3 | is a view corresponding to FIG. 2 after the portable davit base adaptor has been slid laterally into the smaller slot apertures of the mounting plate; |
| FIG. 4 | is a view corresponding to FIG. 3 after the securing pins have been inserted downwardly through the portable davit base adaptor into the mounting plate securing pin apertures; |
| FIG. 5 | is a side elevational view of a davit mast ready to be mounted in a davit mounting assembly with davit pivot pins, and with the roof shown in cross-section; and |
| FIG. 6 | is an end elevational view, partially in section, of a davit mast mounted in a davit mounting assembly showing a horizontal davit pivot pin restraining a securing pin. |

DESCRIPTION OF THE PREFERRED EMBODIMENT

Referring to the drawings, the davit mounting assembly 2 of the invention is attached to an upright tubular davit pedestal 4, which is permanently secured to the steel framework 5 of a roof such as by a weld. A mounting plate 6 fixedly attached to the top of said davit pedestal, such as by a weld, includes two pairs of foot apertures 8, 9 and two circular mounting plate securing pin apertures10, 11, one between each pair of foot apertures 8, 9 and in alignment therewith. The two pairs 8, 9 of four foot apertures are preferably in an arrangement corresponding to the four vertices of a rectangle. The portable davit base adaptor assembly 2 consists of two opposed side plates 14, 15 and two transverse support members 16, 17 fixedly attached, preferably by welding, to side plates 14, 15. Side plates 14, 15 have downwardly extended legs 20 with enlarged distal feet 18 adapted to be received in foot apertures 8, 9 of mounting plate 6. The legs with distal feet 18 preferably form inverted T's to function as hooks in foot apertures 8, 9, to be described. The base adaptor pivot pin apertures 22, 23, aligned to receive davit pivot pins 24 (FIGS. 5 and 6), are coterminous with transverse support members 16, 17. Each of transverse support members 16, 17 has vertically aligned securing pin holes 26, circularly shaped, adapted to allow securing pins 30 to enter and pass through into mounting plate apertures 10, 11 upon completion of installation of assembly 2.

The portable davit base adaptor side plates 14, 15 preferably have oblong shaped handgrip apertures 36, each orientated lengthwise parallel and proximal to the upper edge of side plates 14, 15 such that the handgrip apertures 36 are above the portable davit base adaptor's 2 centre of gravity and readily useable for lifting the portable davit base adaptor 2. Furthermore, each side plate 14, 15 has a safety line aperture 32 located outwardly extended from the base adaptor pivot pin apertures 22 such as to prevent tangling of the safety line with davit mounting assembly 2.

Each of the four mounting plate interlocking foot apertures 8, 9 is in the shape of a keyhole and comprises an enlarged rectangular slot 7 adapted to receive foot 18 and a smaller rectangular slot 7*a* preferably adjacent to the centre of the rectangular slot 7, for lateral reception of and engagement with substantially rectangular lugs 50 formed by inverted T-hooks of feet 18.

With reference now to FIGS. 2–4, the portable davit base adaptor 2 is inserted into the mounting plate 6 in a two-stage motion, wherein the first stage comprises moving the feet 18 of the portable davit base adaptor assembly 2 downwardly through keyhole slots 7 of the foot apertures 8, 9 (FIG. 2) and sliding the portable davit base adaptor 2 laterally, to the right as viewed in FIG. 3, to insert legs 20 into slots 7*a* with engagement of lugs 50 with the underside of plate 6. The height of each leg 20 is slightly greater than the thickness of mounting plate 6 such that interlocking lugs 50 fit snugly under mounting plate 6 to tightly secure the portable davit base adaptor assembly 2. Each of the transverse support member securing pin holes 26 are vertically aligned with a mounting plate securing pin aperture 10 when lugs 50 of 18 are interlocked with the slots 7*a*. The two securing pins 30 are then inserted downwardly through the transverse member securing pin holes 26 and through the mounting plate securing pin apertures 10 as shown in FIG. 3, thusly rigidly attaching the portable davit base adaptor 2 to the mounting plate 6.

Side plate 14 has upper front and upper back base adaptor pivot pin apertures 22, 23 respectively, that are concentrically aligned with the corresponding base adaptor pivot pin apertures 22, 23 of the opposed side plate 15, thusly forming two pairs of base adaptor pivot pin apertures 22 and 23, each aligned to receive a davit pivot pin 24. A transverse member's securing pin hole 26 and vertically aligned mounting plate securing aperture 10, with securing pin 30 inserted, preferably are equidistant between one pair of the concentric base adaptor pivot pin apertures 22 or 23 such that the centre axis line of the inserted securing pin 30 will extendedly intersect with the axis of said pair of concentric base adaptor pivot pin apertures 22 or 23 such that, when a linear davit pivot pin 24 is inserted in the said pair of base adaptor pivot pin apertures 22 or 23 it will be directly above the said inserted securing pin 30, locking securing pin 30 into place and preventing its accidental removal.

A davit mast 34 with a rectangular bottom end formed by brackets 35 welded thereto and sized to fit into the space between the opposed side plates 14, 15 has two pairs of davit mast pivot pin apertures 28, 29 adjusted to align with pivot pin apertures 22, 23. During installation of the davit mast 34, apertures 29 of the mast are aligned with base apertures 23 and a first davit pivot pin 24 inserted for pivotal attachment, and said davit mast 34 pivotally raised to a vertical position aligning pivot pin mast apertures 28 with base apertures 22 such as to allow the insertion of a second davit pivot pin 24, thusly removably attaching the davit mast 34 to portable davit base adaptor 2.

FIG. 6 illustrates a davit mast 34 in its operative mounted position with a pivot pin 24 inserted in mating base apertures 23 and mast base apertures 29 and locked therein with clip 52. Each pivot pin 24 is positioned directly above a securing pin 30, thereby presenting its accidental removal while pivot pin 24 is installed and positively locking the lugs 50 of each of feet 18 in base apertures 8, 9.

The invention provides for an improved portable davit mounting assembly and method for removably attaching it to a rooftop pedestal and mounting plate. The davit mounting assembly has a simple design with few parts. While a preferred embodiment of the invention has been described herein, it is obvious to any one skilled in the art that many variations and modifications are possible without departing from the spirit and the scope of the claims that follow.

It will be understood that other embodiments and examples of the invention will be readily apparent to a person skilled in the art, the scope of the invention being defined in the appended claims.

We claim:

1. A davit mounting assembly, comprising:

a mounting plate for attachment to a davit pedestal, said mounting plate including two pairs of spaced-apart foot apertures and a mounting plate securing pin aperture located between each pair of spaced-apart foot apertures; and a portable davit base adaptor assembly having a pair of spaced-apart opposed side plates joined together by a pair of transverse support members fixedly attached to said side plates, said opposed side plates having two pairs of base adaptor pivot pin apertures, with each pair of base adaptor pivot pin apertures formed in alignment with a corresponding transverse support member, said side plates having two pairs of downwardly extending legs with enlarged distal feet adapted to be received by and interlocked with the mounting plate foot apertures, each pair of said side plate base adaptor pivot pin apertures aligned with each other to receive a davit pivot pin, and each said transverse support member having an aperture for receiving a securing pin for vertical alignment and securement with a mounting plate securing pin aperture when both pairs of feet are interlocked with pairs of mating mounting plate foot apertures, whereby insertion of a davit pivot pin in a pair of aligned side plate apertures blocks removal of a securing pin and prevents removal of the pairs of feet interlocked with mating foot apertures.

2. A davit mounting assembly according to claim 1 wherein each of the four foot apertures comprises two parts, a first and larger part of the aperture shaped to receivable foot, and a second and smaller part of the aperture is a channel cut away from the internal surface of the first part shaped for lateral reception of a leg, with each said second and smaller aperture part channelled at the same angle relative to its corresponding first and larger aperture part.

3. A davit mounting assembly according to claim 1 wherein each leg has an enlarged distal foot and each spaced apart foot apertures is a key hole comprising an enlarged slot adapted to receive an enlarged distal foot therethrough and a narrow slot adjacent the enlarged slot for lateral reception of a leg therein, whereby the enlarged distal feet can engage and become hooked to the mounting plate.

4. A davit mounting assembly according to claim 3 wherein each transverse member hole is vertically aligned with the mounting plate securing pin aperture when the two pairs of legs and feet have been received by the mating two pairs of mounting plate foot apertures, allowing each securing pin to be inserted from the top such to pass through a transverse member hole and be received by the mounting plate securing pin aperture, thusly attaching the portable davit base adaptor assembly to said mounting plate.

5. The davit mounting assembly according to claim 4 wherein each of the two opposed side plates has upper front and upper back base adaptor pivot pin apertures that are concentrically aligned with the corresponding apertures of the opposed plate, thusly forming two pairs of base adaptor pivot pin apertures, each pair aligned to receive a davit pivot pin, such that a davit mast with a bottom end sized to fit into the space in between the opposed side plates and having two pairs of davit mast pivot pin apertures formed to fit concentric and internal to the two pairs of base adaptor pivot pin apertures can be engaged to have a first pair of davit mast pivot pin apertures alignably received by the pair of base adaptor pivot pin apertures and a davit pivot pin inserted for pivotal attachment, and said davit mast pivotally raised to a vertical position aligning all unsecured pivot pin apertures such to allow the insertion of a second davit pivot pin, thusly attaching the davit mast to the portable davit base adaptor.

6. A davit mounting assembly according to claim 5 wherein each mounting plate securing pin aperture and vertically aligned transverse member securing pin holes, with securing pin inserted, are equidistant between a pair of aligned base adaptor pivot pin apertures such that the centre axis line of the securing pin will extendedly intersect with the axis of the base adaptor pivot pin apertures, such that the davit pivot pin will be positioned above the inserted securing pin as to prevent upwards movement of the securing pin, locking the securing pin into place.

7. A davit mounting assembly according to claim 6 wherein the mounting plate is rectangular shaped with the four interlocking foot apertures proximal to the corners of the mounting plate.

8. A davit mounting assembly according to claim 6 wherein each foot aperture comprises two parts, wherein the first part is an rectangular aperture shaped to allow a rectangular shaped portable davit base adaptor interlocking foot to receivably pass through, and the second part is a smaller rectangular channel cut away from an internal side surface of the first part, shaped to receive a rectangular side plate leg.

9. A davit mounting assembly according to claim 6 wherein each side plate has a safety line aperture located outwardly extended from the base adaptor pivot pin apertures such as to prevent tangling of a safety line with davit and davit mounting assembly.

10. A davit mounting assembly according to claim 6 wherein the two mounting plate securing pin apertures are circular.

11. A davit mounting assembly according to claim 6 wherein the transverse support members are fixed to the opposed side plates by means of welding.

12. A davit mounting assembly according to claim 6 having two oblong shaped handgrip apertures, each orientated lengthwise parallel and proximal to the upper edge of side plate, such that said handgrip apertures are above the portable davit base adaptor's centre of gravity and readily useable for lifting the portable davit base adaptor.

* * * * *